US006019169A

United States Patent [19]

Ruppel et al.

[11] Patent Number: 6,019,169

[45] Date of Patent: Feb. 1, 2000

[54] HEAT TRANSFER DEVICE AND METHOD OF MAKING SAME

[75] Inventors: Wolfgang Ruppel, Bad Wildbad; Günther Schmalzried, Korb, both of Germany

[73] Assignee: Behr Industrietechnik GmbH & Co., Germany

[21] Appl. No.: 08/987,384

[22] Filed: Dec. 9, 1997

[30] Foreign Application Priority Data

Dec. 12, 1996 [DE] Germany ..... 196 51 625

[51] Int. Cl.[7] ..... F28F 3/00

[52] U.S. Cl. ..... 165/166; 165/DIG. 906; 165/153; 165/DIG. 505; 165/DIG. 486

[58] Field of Search ..... 165/166, 152, 165/153, 906, 505, 486

[56] References Cited

U.S. PATENT DOCUMENTS

| | | | |
|---|---|---|---|
| 2,846,198 | 8/1958 | Sturges | 165/166 |
| 3,151,676 | 10/1964 | Otto et al. | 165/166 |
| 4,434,845 | 3/1984 | Steeb | 165/906 |
| 4,448,245 | 5/1984 | De Palezieux | 165/906 |
| 4,473,111 | 9/1984 | Steeb | 165/906 |
| 4,804,041 | 2/1989 | Hasegawa et al. | 165/166 |
| 4,934,455 | 6/1990 | Hasegawa | 165/166 |
| 4,966,231 | 10/1990 | Belcher et al. | 165/166 |
| 5,538,079 | 7/1996 | Pawlick | 165/153 |
| 5,845,701 | 12/1998 | Ruppel et al. | 165/153 |

FOREIGN PATENT DOCUMENTS

| | | |
|---|---|---|
| 2570481A1 | 3/1986 | France . |
| 1961218 | 7/1970 | Germany . |
| 2342787A1 | 3/1975 | Germany . |
| 2462401A1 | 12/1976 | Germany . |
| 3733866A1 | 4/1989 | Germany . |

OTHER PUBLICATIONS

Search Report 04/16/1997 ,Gremany.

*Primary Examiner*—Ira S. Lazarus
*Assistant Examiner*—Terrell McKinnon
*Attorney, Agent, or Firm*—Evenson, McKeown, Edwards & Lenahan, P.L.L.C.

[57] ABSTRACT

Finned-tube blocks of charge air coolers of stacked construction are provided with end strips forming a tube bottom. Side surfaces of the end strips adjoining the coolant ducts are configured as exterior surfaces of lips projecting in a direction of the corrugated fins, the tips of these lips not touching the corrugated fins. The end strip cross-section, however, uniformly increases toward the side facing away from the corrugated fins. This further development leads to a considerable reduction of thermal induced tension peaks and therefore contributes to lengthening the useful life of charge air coolers provided with such finned-tube blocks.

8 Claims, 3 Drawing Sheets

HEAT TRANSFER DEVICE AND METHOD OF MAKING SAME

BACKGROUND AND SUMMARY OF THE INVENTION

This application claims the priority of German application 196 51 625.0 filed in Germany on Dec. 12, 1996, the disclosure of which is expressly incorporated by reference herein.

The invention relates to a heat transfer device, particularly a charge air cooler in a stack construction, having a finned-tube block which is constructed of several layers of ducts for the coolant flowing through, which extend in parallel to one another, and of lamella-type corrugated fins which are in each case inserted between these layers and which, in the area of the ends of the ducts leading into the coolant tanks, each rest against supporting fins of end strips which are inserted between adjacent layers of ducts for forming the tube bottom.

Heat transfer devices of this type and their finned-tube blocks are subjected to very high change-of-temperature stress. It is known that, in the case of charge air coolers, as used, for example, for large 2,000 kW engines or for high-power engines for utility vehicles, charge air temperature of a magnitude of 235° C. or more occur on the inlet side during the full-load operation. In the case of known heat transfer devices of this type (German Patent Document DE-OS 23 42 787), it cannot be prevented that the ducts expand relatively fast on the air inlet side. The thermal expansion has the result that local tension peaks occur at the soldered joints between the end strips and the ducts, which tension peaks may result in damage during frequent load changes and thus in a shorter useful life of the finned-tube blocks.

It is an object of the present invention to develop a heat transfer device of the initially mentioned type such that the mentioned local tension peaks can be avoided.

For achieving this object, it is provided according to the invention that, in the case of a heat transfer device of the initially mentioned type, the lateral surfaces of the end strips resting against the ducts form the exterior surfaces of lips projecting in the direction of the corrugated fins, the points of these lips not contacting the corrugated fins and their cross-section increasing uniformly toward the side facing away from the corrugated fins.

Because of the absence of an abrupt jump of the cross-section at the transition between the supporting fins and the ducts, this further development achieves a clear reduction of the local tension peaks and thus also a reduction of the component load in the tube bottom area. As a result, the useful life of heat transfer devices of the initially mentioned type can be extended.

As a further development of the invention, one groove respectively may be formed between the lip and the supporting fin, in which case the wall of the groove pointing to the lip may form a parabolically curved surface. It was found that by means of such a further development the desired uniform increase of the cross-section of the exterior lip is achieved and, as a result, tension concentrations and undesired tension peaks are avoided.

As a further development of the invention, each end strip may have a supporting fin which is arranged in the center and whose width amounts to approximately one third of the width of the end strip. In a simple manner, the supporting fin may have a rectangular cross-section. End strips of the type used for the invention can easily be made, for example, of aluminum by means of extruding. It was found to be particularly advantageous for these end strips to consist of an aluminum magnesium alloy.

Other objects, advantages and novel features of the present invention will become apparent from the following detailed description of the invention when considered in conjunction with the accompanying drawings.

DETAILED DESCRIPTION OF THE DRAWINGS

Figure 1:
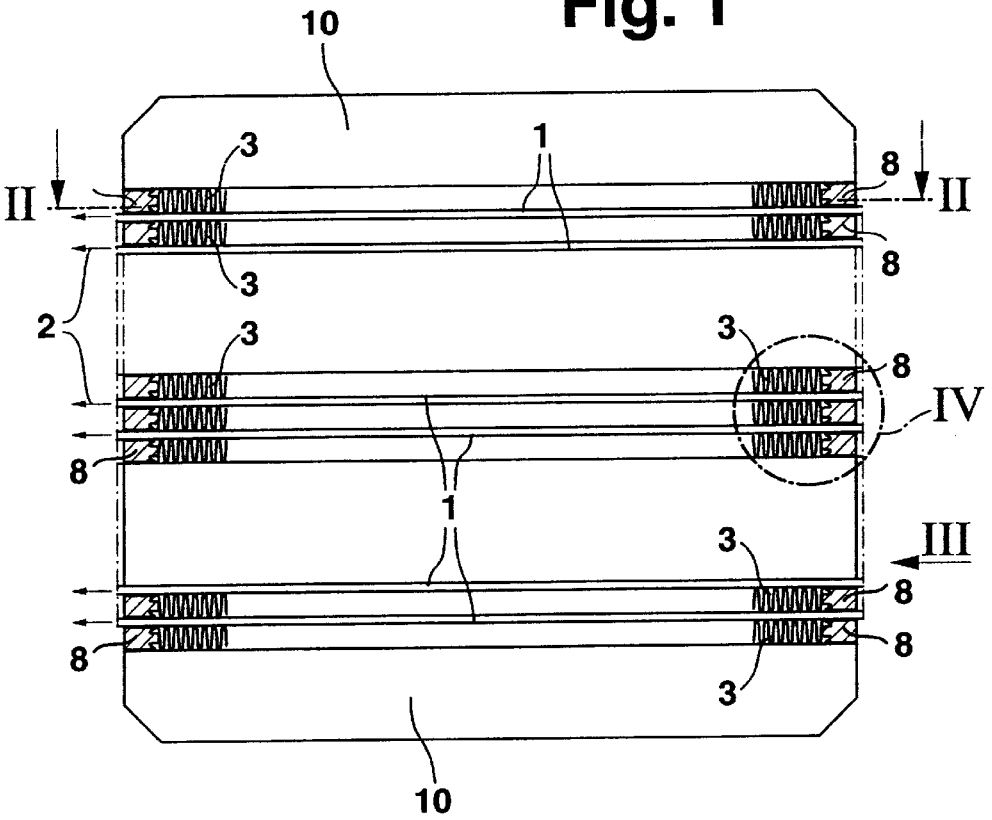
FIG. 1 is a schematic representation of a cross-section of a heat transfer device according to the invention which is constructed as a charge air cooler.
Figure 2:
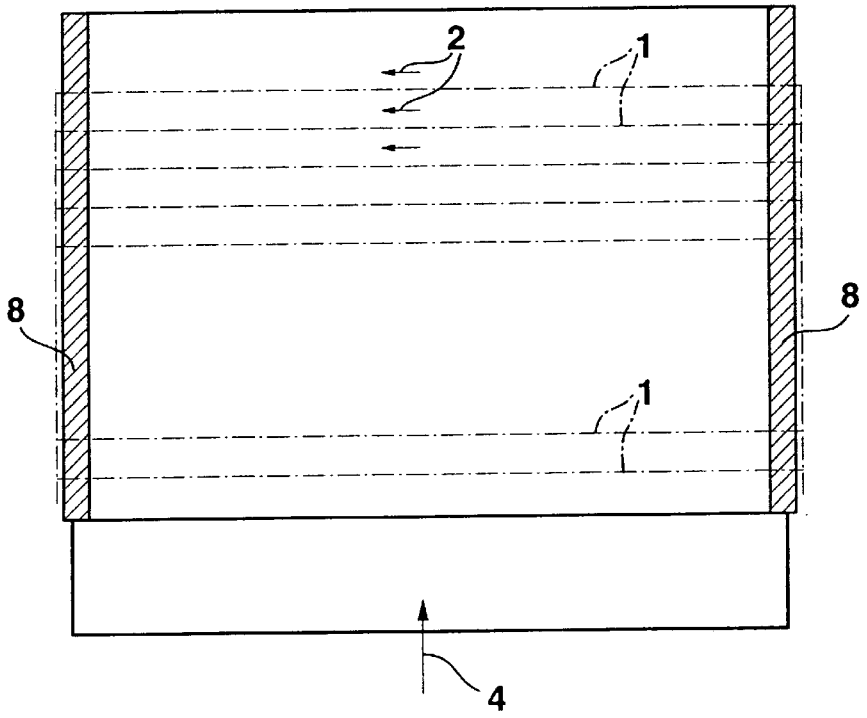
FIG. 2 is a sectional representation of the heat transfer device of FIG. 1 in the direction of the intersection line II—II.
Figure 3:
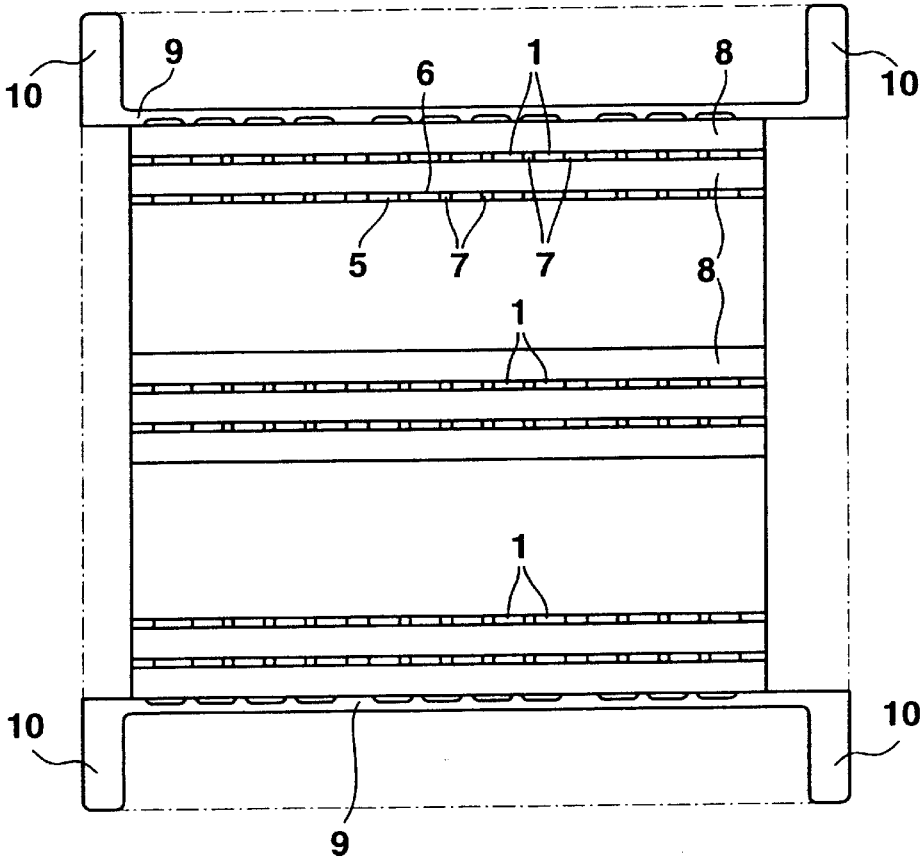
FIG. 3 is a lateral view of the heat transfer device of FIG. 1 viewed in the direction of the arrow III of FIG. 1.

FIGS. 1 to 3 show a finned tube block according to the invention for a charge air cooler which consists of several layers of ducts 1 which extend in parallel to one another and through which a liquid coolant flows in the direction of the arrows 2. Lamella-type corrugated fins 3 extend in each case between the layers of the ducts 1. Perpendicularly to the flow direction 2 of the coolant, charge air flows through these lamella-type corrugated fins 3 in the direction of the arrow 4 in FIG. 2. In this case, as illustrated in FIG. 3, the individual ducts 1 may be formed by stacking one lower metal sheet 5 and one upper metal sheet 6 respectively upon one another which are spaced with respect to one another by inserted strips 7. Ducts 1 for the coolant are therefore formed between the strips 7. The layers of the coolant ducts 1 formed in this manner are, in turn, held in parallel at a distance from one another by means of end strips 8 in the area of their ends. This distance makes it possible to insert the corrugated fins 3 such between the ducts 1 that a contact exists between the corrugated fins 3 and the ducts 1—or the metal sheets 5, 6 forming the ducts. After the stacking, the finned tube blocks are soldered together in a known manner.

It is also contemplated to form the ducts 1 as continuous hollow spaces in extruded profiles which consist, for example, of aluminum. The above-mentioned metal sheets 5, 6 and the strips 7 may also consist of aluminum.

The end strips 8 inserted in this manner between the individual layers of the ducts 1 at their ends together form a continuous tube bottom which, in a known but not illustrated manner, can be covered in a hood-shaped fashion by coolant tanks through which the coolant can be guided to the ducts 1 and in the direction of the arrows 2 through these ducts. The thus formed finned-tube block is provided with lateral parts 9 which are provided with laterally upright flanges 10, as illustrated in FIGS. 1 and 3.

Figure 4:
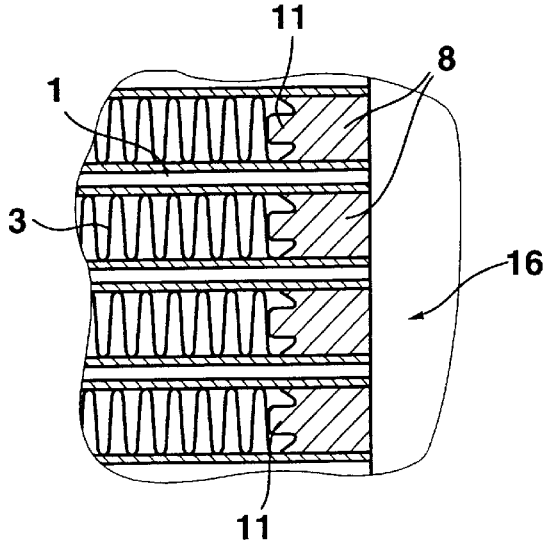
FIG. 4 is an enlarged representation of the detail IV in FIG. 1.
Figure 5:
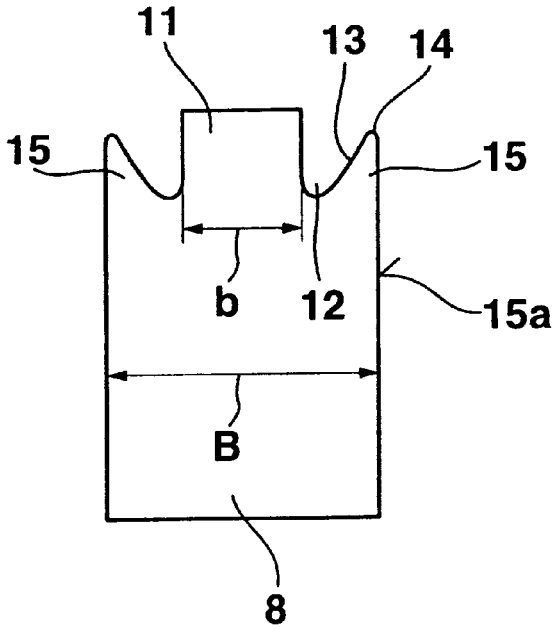
FIG. 5 is an enlarged representation of the frontal view of an end strip according to FIG. 4 used for the invention.
Figure 6:
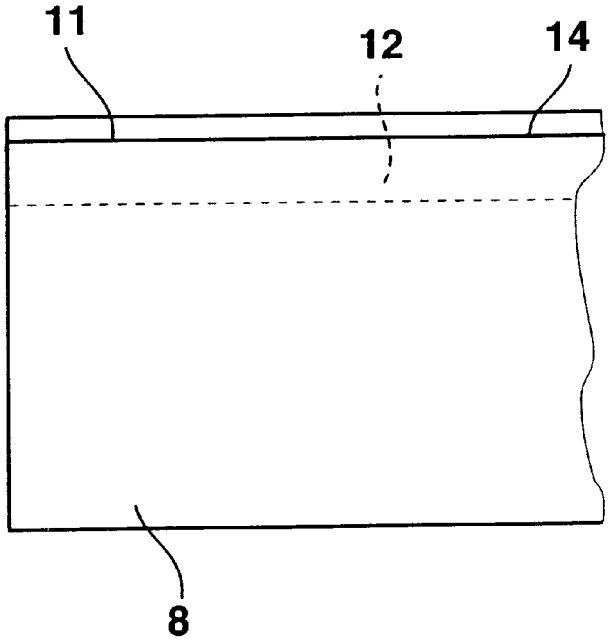
FIG. 6 is a lateral view of the supporting strip of FIG. 5.

Particularly FIG. 4 shows that, in the area of the ends of the coolant ducts 1, the corrugated fins 3 adjoin the end strips 8, specifically in each case on a supporting fin 11 which is provided in the center of each end strip 8 and which has a rectangular cross-section. FIGS. 4 to 6 show that this center supporting fin 11 is adjoined on both sides by grooves 12 whose exterior wall 13 in each case has approximately the shape of a parabolic surface which merges into the tip 14 of a lip 15 whose exterior surface 15*a* also forms the lateral surface of the end strip 8. The end strip 8 is therefore disposed on the metal sheets 5 or 6 by means of the exterior surfaces 15*a* of the lip 15 or rests against the walls of the previously mentioned extruded profile by means of which the coolant ducts 1 are bounded on two sides. However, the tip 14 of each of the two lips 15 does not protrude so far that the corrugated fins 3 are touched. As also mentioned above, the corrugated fins 3 are supported exclusively on the center supporting fin 11. As illustrated in FIGS. 4 and 5, in the case of the embodiment shown, the width b of the supporting fin 11 amounts to approximately one third of the width B of the end strip 8.

The selected further development of the end strips 8, which together form the tube bottom for the coolant tank 16 schematically indicated in FIG. 4, because of this further development, have no cross-sectional shape in the case of which an abrupt transition exists from the wall 5 or 6 of the coolant ducts 1 to the supporting fin 11 and to the space through which the charge air flows and in which the corrugated fin is situated. As indicated in tests, this has the result that, also in the case of extreme load changes, no temperature peaks are built up during the operation of the charge air cooler as in the case of charge air coolers of a conventional construction in the area of the exterior surface 15*a* which may lead to damage of the soldered connection and thus of the finned tube block. This will naturally also apply if the coolant ducts 1 are parts of extruded profiles which are also stacked together in the manner of stacks with the end strips 8 and the corrugated fins to form the finned tube block which subsequently will be soldered together in a known manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Heat transfer device, particularly a charge air cooler in a stack construction, having a finned-tube block which is constructed of several layers of ducts for the coolant flowing through, which extend in parallel to one another, and of lamella-type corrugated fins which are in each case inserted between these layers and which, in the area of the ends of the ducts leading into the coolant tanks, each rest against supporting fins of end strips which are inserted between adjacent layers of ducts for forming the tube bottom, wherein the lateral surfaces of the end strips which rest against the ducts form exterior surfaces of lips projecting in a direction of the corrugated fins, tips of the lips not contacting the corrugated fins and their cross-section increasing uniformly toward a side facing away from the corrugated fins, wherein one groove respectively is formed between the lip and the supporting fin, wherein a wall of the groove which faces the supporting fin forms a parabolically curved surface, and wherein the width of the supporting fin amounts to approximately one third of the width of the end strip.

2. Heat transfer device according to claim 1, wherein each end strip has a supporting fin arranged in the center.

3. Heat transfer device according to claim 4, wherein the supporting fin has a rectangular cross-section.

4. Heat transfer device according to claim 1, wherein the supporting fin has a rectangular cross-section.

5. A charge air cooler finned-tube block comprising:

a plurality of layers of coolant ducts extending parallel to one another and connecting respective coolant tanks at their ends, lamella type corrugated fins inserted between said layers of coolant ducts, and end strips forming coolant duct bottoms at respective ends of said tubes, said end strips being inserted between respective coolant duct layers and having lateral surfaces contacting respective coolant ducts, wherein said end strips are configured to contact respective ones of said corrugated fins and exhibit an increasing cross-section in a direction away from said corrugated fins, whereby thermal expansion induced tension peaks are minimized, wherein each end strip has a supporting fin arranged in the center and a groove at each side of the supporting fin, each of said grooves being bounded on a first side by the supporting fin and on a respective facing side by slip projecting toward and spaced from a corrugated fin supported by the supporting fins, and wherein said facing side is configured with a parabolically curved surface, and wherein the width of the supporting fin amounts to approximately one third of the width of the end strip.

6. A charge air cooler finned-tube block according to claim 5, wherein the supporting fin has a rectangular cross-section.

7. A method of making a charge air cooler finned-tube block, comprising:

forming alternating layers of parallel coolant ducts and corrugated fins, and connecting said layers together with interposition of end strips forming coolant duct bottoms at respective ends of said tubes, said end strips being inserted between respective coolant duct layers and having lateral surfaces contacting respective coolant ducts, wherein said end strips are configured to contact respective ones of said corrugated fins and exhibit an increasing cross-section in a direction away from said corrugated fins, wherein each end strip has a supporting fin arranged in the center and a groove at each side of the supporting fin, each of said grooves being bounded on a first side by the supporting fin and on a respective facing side by a lip projecting toward and spaced from a corrugated fin supported by the supporting fin, wherein said facing side is configured with a parabolically curved surface, and wherein the width of the supporting fin amounts to approximately one third of the width of the strip, whereby thermal expansion induced tension peaks are minimized by the configuration of the end strips.

8. A method according to claim 7, wherein said connecting includes soldering said layers together.

* * * * *